US010436046B2

(12) United States Patent
Fentem et al.

(10) Patent No.: US 10,436,046 B2
(45) Date of Patent: Oct. 8, 2019

(54) METHOD FOR ASSEMBLING A STATOR STAGE OF A GAS TURBINE ENGINE

(71) Applicant: Siemens Aktiengesellschaft, Munich (DE)

(72) Inventors: Jed Fentem, Lincoln (GB); Paul Jenkinson, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 482 days.

(21) Appl. No.: 15/311,923

(22) PCT Filed: May 22, 2015

(86) PCT No.: PCT/EP2015/061452

§ 371 (c)(1),
(2) Date: Nov. 17, 2016

(87) PCT Pub. No.: WO2015/185382

PCT Pub. Date: Dec. 10, 2015

(65) Prior Publication Data

US 2017/0089209 A1 Mar. 30, 2017

(30) Foreign Application Priority Data

Jun. 2, 2014 (EP) ..... 14170842

(51) Int. Cl.
*F01D 9/04* (2006.01)
*F01D 11/02* (2006.01)

(52) U.S. Cl.
CPC ..... *F01D 9/042* (2013.01); *F01D 11/025* (2013.01); *F05D 2220/32* (2013.01);
(Continued)

(58) Field of Classification Search
CPC ..... F01D 9/042; F01D 11/025
See application file for complete search history.

(56) References Cited

U.S. PATENT DOCUMENTS 3,302,926 A * 2/1967 Bobo ..... F01D 9/042 415/136
4,890,978 A 1/1990 McLaurin et al.
(Continued)

FOREIGN PATENT DOCUMENTS

CN 1042397 A 5/1990
CN 102317577 A 1/2012
(Continued)

OTHER PUBLICATIONS

Russian Federation office action dated Mar. 15, 2018, for RU patent application No. 2016147075.
(Continued)

*Primary Examiner* — Woody A Lee, Jr.
(74) *Attorney, Agent, or Firm* — Beusse Wolter Sanks & Maire

(57) ABSTRACT

A method for assembling a stator stage of a gas turbine engine and an adjustment pin to perform the assembly method to lock a vane segment in a central section of the stator stage. The method includes inserting an adjustment pin into a through hole wherein the adjustment pin includes two end sections, inserting at least one wall segment of the vane segment into a slot of a central section, rotating the adjustment pin so that the central section is correctly positioned in the stator stage, deforming a deformable part of the adjustment pin so that the now deformed part establishes a force fit with at least one segment of a corresponding structure of the central section and thereby locking the adjustment pin and thus the central section in a fixed position in the stator stage.

14 Claims, 5 Drawing Sheets

(52) U.S. Cl.
CPC ..... *F05D 2230/20* (2013.01); *F05D 2230/60* (2013.01); *F05D 2230/644* (2013.01)

(56) References Cited

U.S. PATENT DOCUMENTS

| | | | | |
|---|---|---|---|---|
| 5,271,714 | A | 12/1993 | Shepherd et al. | |
| 5,772,401 | A | 6/1998 | Canova | |
| 8,992,167 | B2 * | 3/2015 | Casavant | F01D 25/243 415/173.1 |
| 9,133,732 | B2 * | 9/2015 | Afanasiev | F01D 9/042 |
| 10,285,572 | B2 * | 5/2019 | Wieters | A61B 1/00096 |
| 2011/0293412 | A1 | 12/2011 | Afanasiev | |
| 2012/0039719 | A1 * | 2/2012 | Ahaus | F01D 5/081 416/220 R |
| 2012/0128504 | A1 | 5/2012 | Ahaus et al. | |
| 2014/0314550 | A1 * | 10/2014 | Jenkinson | F01D 9/042 415/148 |

FOREIGN PATENT DOCUMENTS

| | | | |
|---|---|---|---|
| EP | 2594743 | A1 | 5/2013 |
| RU | 1077380 | C | 6/1995 |
| RU | 55443 | U1 | 8/2006 |
| WO | 2011150025 | A1 | 12/2011 |

OTHER PUBLICATIONS

EP Search Report dated Nov. 18, 2014, for EP application No. 14170842.0.
International Search Report dated Oct. 23, 2015, for PCT application No. PCT/EP2015/061452.
CN Office Action dated Jun. 27, 2017, for CN patent application No. 201580029039.9.

* cited by examiner

METHOD FOR ASSEMBLING A STATOR STAGE OF A GAS TURBINE ENGINE

CROSS REFERENCE TO RELATED APPLICATIONS

This application is the U.S. National Stage of International Application No. PCT/EP2015/061452 filed May 22, 2015, and claims the benefit thereof. The International Application claims the benefit of European Application No. EP14170842 filed Jun. 2, 2014. All of the applications are incorporated by reference herein in their entirety.

FIELD OF THE INVENTION

The present invention relates to a method for assembling a stator stage of a gas turbine engine. The present invention further relates to an adjustment pin to perform the assembly method and a use of the adjustment pin in the inventive method to lock a vane segment in a central section of the stator stage.

BACKGROUND TO THE INVENTION

A gas turbine engine comprises stator stages and rotor stages. The stator stages are located adjacent to the rotor stages. In order to provide a proper sealing of the stator stage between a high pressure side and a low pressure side which are divided by the stator stage, a central section, in particular the static diaphragm, of the stator stage should accurately be located relative to the rotating components, i.e. a turbine shaft and the adjacent rotor stages. Moreover, supporting elements of the central section should also allow a relative radial expansion while maintaining an accurate circumferential location. Furthermore, a proper balancing of the axial loads caused by the pressure differential across the stator stage should be achieved. It is currently known to use a pre-assembling arrangement where the central section of a stator stage is adjusted by key blocks and dowels that are drilled and fixed to the stator stage assembly. During the pre-assembling, an interim carrier ring substitutes a stator casing and vane sections with key block are positioned in the interim carrier ring. Subsequently, the vane segments are positioned by location pins in the casing and the central section is manually positioned to gain concentricity with regards to the casing. After aligning a through hole is drilled through the key blocks at the overlapping portions of the central section and the vane section. After the drilling the assembly is disassembled, cleaned and the vane segments are inserted in the central section. Next, a dowel is fixed into the through hole in order to fix the relative position between the central section and the vane section.

Such an assembling needed three days for the assembling. Moreover, the assembling, cleaning and re-assembling adds a high risk of damaging components due to increased handling. All this makes the process costly and reduces the capacity in core build.

It is a first objective of the present invention to provide a method for assembling a stator stage of a gas turbine engine with which the above-mentioned shortcomings can be mitigated, and especially providing a quick locking of a vane segment at a central section and facilitate a save assembling that also reduces costs.

It is a second objective of the invention to provide an adjustment pin to assemble the vane segment and the central section easy and quick as well as lock the central section properly. A third objective of the invention is to provide a use of an adjustment pin in the inventive method for proper locking of the vane segment in the central section of the stator stage.

These objectives may be solved by a method, an adjustment pin and a use of the adjustment pin according to the subject-matter of the independent claims.

SUMMARY OF THE INVENTION

Accordingly, the present invention provides a method for assembling a stator stage of a gas turbine engine, comprising at least one vane segment and at least a central section, wherein the vane segment comprises at least one wall segment and a gap, wherein the at least one wall segment restricts the gap in at least one direction, wherein the central section comprises at least one circumferential slot and an axial through hole passing in a direction basically perpendicular to a circumferential direction of the slot through the slot, wherein the method comprises the steps of: Inserting an adjustment pin, into the through hole, wherein the adjustment pin comprises two end sections and a middle portion extending between the end sections and having at least one action device, inserting the at least one wall segment of the vane segment in the slot of the central section so that the gap is circumferentially aligned with the through hole of central section, rotating the adjustment pin in its circumferential direction so that the central section is correctly positioned in the stator stage and/or in respect to an inner casing of the stator stage through interaction of the at least one wall segment with the at least one action device of the adjustment pin.

It is provided that the method comprises the further steps of: Deforming a deformable part of the adjustment pin so that the now deformed part establishes a force fit with at least one segment of a corresponding structure of the central section and thereby locking the adjustment pin and thus the central section in a fixed position in the stator stage.

Due to the inventive method the assembling is simplified in comparison with state of the art methods. Further, the method allows for a quick rotational locking of the adjustment pin and thus of the central section and the vane segment. Since the steps of assembling, cleaning and re-assembling are omitted the risk for damaging parts of the stator stage and especially of the vanes and their delicate coatings is minimised. Additionally, this also allows assembling and installing the stator stage inside a clean room environment. Moreover, because the need of key blocks inside the slot of the central section is obsolete, the amount of parts is also reduced and thus the overall weight and the overall costs. Furthermore, assembling time is reduced by about a factor of three. This time reduction reduces cost and improves capacity in core build. Moreover, storage space can be advantageously saved.

Even if a term like vane segment, central section, wall segment, gap, slot, through hole, end section, middle portion or action device, deformable part, corresponding structure, protrusion, groove, drive slot, sector is used in the singular or in a specific numeral form in the claims and the specification the scope of the patent (application) should not be restricted to the singular or the specific numeral form. It should also lie in the scope of the invention to have more than one or a plurality of the above mentioned structure(s).

A stator stage may be any stage in a gas turbine engine feasible for a person skilled in the art. Advantageously it is a stage of a turbine section of the gas turbine engine positioned intermediate to two rotor stages and is also referred to as a nozzle assembly. A vane segment is an assembly with at least one aerofoil, embodied as a vane, and an assembly section with at least one wall segment, like a radially extending protrusion intended to interact with the central section during assembly. The vane segment may further comprise an inner and an outer platform or shroud, wherein the outer platform is used to connect the stator stage with a casing of the gas turbine engine.

The central section comprises at least a slot intended to receive the assembling section of the vane segment and a through hole intended for the receiving of the adjustment pin. The slot is advantageously embodied as a circumferential slot in the outer circumference with a radial depth to receive the assembling section of the vane segment. Moreover, the central section comprises a centre hole for mounting of the stator stage to a turbine shaft of the gas turbine engine, thus the turbine shaft is insertable through the centre hole. A radially inner surface of the centre hole is either in slidable contact with the turbine shaft or comprises sealing elements which seals a gap between the radially inner surface and the turbine shaft for sealing purposes. In order to provide a proper sealing, the central section has to be adjusted properly with respect to the turbine shaft.

The central section is supported and fixed to the vane segment which is again fixed to the housing/casing of the gas turbine engine. In addition, the central section or inner ring transfers cooling air that passes through the vanes/nozzles into a pre-swirl ring and then onto a disc cavity of an adjacent turbine wheel to provide pressure. Advantageously, the central section is aligned with respect to the turbine shaft in such a way that a centre point of the centre hole is located onto the rotary axis of the turbine shaft. In other words, the central section is adjusted advantageously in such a way that the central section is concentric with the rotary axis of the turbine shaft. Alternatively, depending on where in the turbine section the stator stage is located, particular in relation to the rotor bearings, a slightly offset position between the centre of the turbine shaft and the centre hole may be advantageous to compensate for any bending of the turbine rotor that may occur during operation from rotor dynamics and thereby minimise the clearance and leakage path between the static and rotating part.

The order or sequence of insertion of the adjustment pin and the vane segment may be reversed. Thus the vane segment may be inserted first and the adjustment pin thereafter. The insertion may be even performed simultaneously. It may be also possible to insert the pieces, like the vane segment or the adjustment pin, stepwise or alternatingly. In other words, it may be possible to first insert the piece (vane segment or wall segment thereof, adjustment pin) partially, subsequently insert the other part (adjustment pin or vane segment) and finally insert the up till now partly inserted part (vane segment or adjustment pin) fully.

In case the adjustment pin is inserted first and the wall segment of the at least one vane segment subsequently, the adjustment pin is advantageously held in position by the vane segment or between radial extension thereof as these are axially narrower than the end sections of the adjustment pin. Hence, the vane segment or its extensions are trapped between the end sections of the adjustment pin and consequently the adjustment pin cannot move axially beyond the play of the assembly. Thus, by inserting the at least one wall segment of the vane segment in the slot of the central section the adjustment pin is axially locked into position in the central section or its through hole.

After the vane segment(s), the adjustment pin(s) and the central section are assembled the method comprises the further step of: Placing the assembly within a casing and/or a carrier ring of the stator stage. Moreover, the method comprises the further step of: Positioning the at least one vane segment at the inner casing by location pins. Thus, via the rotation of the adjustment pins and the interaction with the wall segment of the vane segment the central section can be positioned in respect to the inner casing of the stator stage.

A deformable part should be understood as a part that can be deformed or processed or that is processable and specifically shape processable or processable in shape. The occurring deformation causes a detectable change, like a change in shape, of the deformable part. In this context, a minor deformation should not be understood as a deformation according to the invention. The force fit is established between the now deformed part and at least a section of the corresponding structure. There may be a contact of a first degree, like a loose contact, between the deformable part and the at least one segment of the corresponding structure that will be strengthened during the deformation and locking to a second degree. Alternatively and advantageously, there will be no contact between the deformable part and the at least one segment of the corresponding structure before the deformation and locking and the contact will be established due to the deformation and locking. Additionally to the force fit there may be also a form fit between the deformable part and the at least one segment of the corresponding structure.

An adjustment pin is for example a dowel. The deformation may be facilitated by any mechanism feasible for a person skilled in the art, like a thermal processing, e.g. welding, brazing, sintering or laser treatment, or a mechanical processing. Advantageously, it is provided that the deformable part of the adjustment pin is deformed by peening. Thus, an easy process can be used. Further, special, complex and expensive treatment means can be avoided. Beneficially, at least one section of the deformable part of the adjustment pin is deformed. This reduces the time and the treatment strength or force and needed for the deforming process. Moreover, it may be a space saving solution. Generally, it would also be possible to deform the entire deformable part.

In an advantageous embodiment the deformable part is embodied as a protrusion of at least one end section of the adjustment pin. Hence, the deformable part is easily accessible. Advantageously, the deformable part extends in an axial direction of the adjustment pin and at least partially along a circumference of the at least one end section. Due to this, the deformable part is a space saving, compact arrangement. In other words, the deformable part is a castellated circumference or ridge. The axial protrusion or overlap over a radial surface of the end section may be between 5 millimeter (mm) and 0.5 mm, in particular between 3 mm and 1 mm, more particular between 2.25 mm and 1.75 mm and most particular 2 mm. In other words, the protrusion may have an axial length between 5 millimeter (mm) and 0.5 mm, in particular between 3 mm and 1 mm, more particular between 2.25 mm and 1.75 mm and most particular of 2 mm.

Moreover, for greater sizes of gas turbine engines the radial protrusion or overlap may be greater than 5 mm or even 10 mm to 20 mm. Generally, the proportions of the protrusion remain similar with regards to the diameter of the adjustment pin and the axial length of the protrusion may be between 5% to 20% of the diameter of an end section of the adjustment pin.

The corresponding structure of the central section may be any structure suitable for a person skilled in the art, like an interaction surface, a bulge, a bump, a recess, a slot or a groove. A part of the corresponding structure is a section of the corresponding structure that contacts the deformable part or a section thereof and establishes thereby the force fit. Thus, it may be possible that the whole corresponding section contacts the deformable part or just a part or parts thereof, like a bottom and/or a top and/or a wall. In a further advantageous embodiment the corresponding structure of the central section is a groove, wherein the deformed part of the adjustment pin is locked in the groove of the central section. The embodiment as a groove provides a space efficient structure. The corresponding structure is easy to manufacture, when the groove extends in an outer surface of the central section and in circumferential direction of the central section. In case of a deforming of the entire deformable part the corresponding structure could be a circular groove with a slightly wider diameter than the diameter of the end section comprising the deformable part.

The corresponding structure may have additional functions. In case of an embodiment as a groove that may be the use of the groove as a reference or as a fix location e g a tool end resting in the groove for measuring/repair operations particularly in the centre hole for example related to seal features.

Advantageously, at least two deformed sections of the deformed part are built during the deformation. Hence, the locking is particularly secure. According to a further realisation of the invention the central section comprises at least two circumferential grooves in an outer surface of the central section and wherein each deformed section is locked in one of the two circumferential grooves. This avoids an accidental alignment of a drive slot provided to rotate the adjustment pin and dividing the deformable part with a sole groove. Such an alignment would prevent the deforming due to missing material of the deformable part in end regions of the slot. The two grooves are advantageously arranged in parallel towards each other in circumferential direction of central section. A width of the groove is selected in such a way to provide enough interlocking space with the deformable part or the axial protrusion, respectively.

Beneficially, the deformable part of the adjustment pin is arranged in such a way in the through hole to be accessible from an outside of the stator stage. Consequently, a tool for rotating the adjustment pin can actuate the adjustment unhindered. Therefore the adjustment pin comprises at least one drive slot (see below).

The action device of the middle portion of the adjustment pin may be any means feasible for a person skilled in the art, like a recess, a lug or a shape (e.g. elliptic or egg shaped) and advantageously a specifically selected arrangement of the middle portion in respect to the end sections. According to a further embodiment of the invention the action device of the adjustment pin is embodied as an eccentrically arranged middle portion and wherein the eccentric middle portion contacts the at least one wall segment of the vane segment to correctly position the central section in the stator stage and/or in respect to the inner casing. Thus, the vane segment can be positioned constructively easy just by rotating the adjustment pin.

A concentricity of the central section with respect to the rotary axis of the turbine shaft is achievable and/or a relative radial and tangential/circumferential position of the central section is adjustable by pivoting the adjustment pin, because the end sections of the adjustment pin are coupled to the central section and the eccentric middle portion of the adjustment pin is coupled to the assembly section of the vane segment. The central section may thus be moved relative to the vane segment along a radial and/or circumferential direction by adjusting the adjustment pin.

In a further advantageous embodiment of the invention the adjustment pin and/or the central section is locked in its circumferential position in the stator stage. Hence, the locking is mediated simply by the rotation of the adjustment pin.

The present invention further relates to an adjustment pin embodied in such a way to perform the inventive method.

Hence, an adjustment pin with two end sections and with a middle portion extending between the two end sections and having an action device is provided.

It is proposed that the adjustment pin comprises a deformable part embodied in such a way to established a force fit with at least a part of a corresponding structure of a central section of a stator stage and thereby locking the adjustment pin and thus the central section of the stator stage into a fixed position in the stator stage in an assembled state of the stator stage.

Due to the inventive matter the assembling is simplified in comparison with state of the art methods. Further, the such embodied assembling pin allows for its quick rotational locking. Since the assembling, cleaning and re-assembling steps are omitted the risk for damaging parts of the stator stage and especially of the vanes and their delicate coatings is minimised. Additionally, this also allows assembling and installing the stator stage inside a clean room environment. Moreover, because the need of key blocks inside the central section slot is obsolete, the amount of parts is also reduced and thus the overall weight and the overall costs. Furthermore, assembling time is reduced by about a factor of three. This time reduction reduces cost and improves capacity in core build. Moreover, storage space can be advantageously saved.

As stated above the adjustment pin comprises the deformable part that is embodied as a protrusion of at least one end section of the adjustment pin. Hence, the deformable part is easily accessible. Advantageously, the deformable part extends in an axial direction of the adjustment pin and at least partially along a circumference of the at least one end section. Due to this, the deformable part is a space saving, compact arrangement. In other words, the deformable part is a castellated circumference or ridge.

In a further realisation of the invention it is provided that the adjustment pin comprises a drive slot extending basically perpendicular to the axial direction of the adjustment pin. As a result, the adjustment pin can be easily actuated e.g. by a screw driver. Advantageously, the drive slot is positioned in one of the end sections of the adjustment pin providing good access for the actuation of the adjustment pin. Advantageously, the drive slot divides the deformable part in two sectors. Hence, the drive slot can be inserted in the adjustment pin easily.

As discussed above the embodiment with two grooves that engage two deformable sections of the deformable part is needed to avoid the problem of missing material for the deformation at the regions where the drive slot divides the deformable part or circumferential ridge. This problem could be solved by using a shorter slot that avoids dividing or does not divide the deformable part. According to an alternative embodiment the drive slot is embodied as a hex head slot providing a means to interact with another kind of tool than the standard screw driver. In a further alternative embodiment the drive slot is embodied as a cross head slot providing still another actuation possibility. Nevertheless, the embodiment of the drive slot as a rectangular slot has the advantage that it represents and shows the orientation of the adjustment pin. That is especially advantageous when the action device is the eccentrically arrangement of the middle portion in respect to the end section.

As stated above the adjustment pin comprises a first and a second end section. In a further alternatively embodiment it is provided that the drive slot is arranged in the first end section and the deformable part is arranged at the second end section. Thus a possible conflict during machining, actuating or treatment of the deformable part and the drive slot can be avoided.

The present invention further relates to a use of the inventive adjustment pin in the inventive method to lock the central section in the stator stage and/or in respect to the inner casing of the stator stage.

Due to the inventive use the assembling is simplified in comparison with state of the art methods. Further, the use allows for a quick rotational locking of the adjustment pin. Since the assembling, cleaning and re-assembling steps are omitted the risk for damaging parts of the stator stage and especially of the vanes and their delicate coatings is minimised. Additionally, this also allows assembling and installing the stator stage inside a clean room environment. Moreover, because the need of key blocks inside the central section slot is obsolete, the amount of parts is also reduced and thus the overall weight and the overall costs. Furthermore, assembling time is reduced by about a factor of three. This time reduction reduces cost and improves capacity in core build. Moreover, storage space can be advantageously saved.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENTS

The terms upstream and downstream refer to the flow direction of the airflow and/or working gas flow through the gas turbine engine 12 unless otherwise stated. If used and not otherwise stated, the terms axial, radial and circumferential are made with reference to a rotational axis 66 of the gas turbine engine 12.

Figure 1:
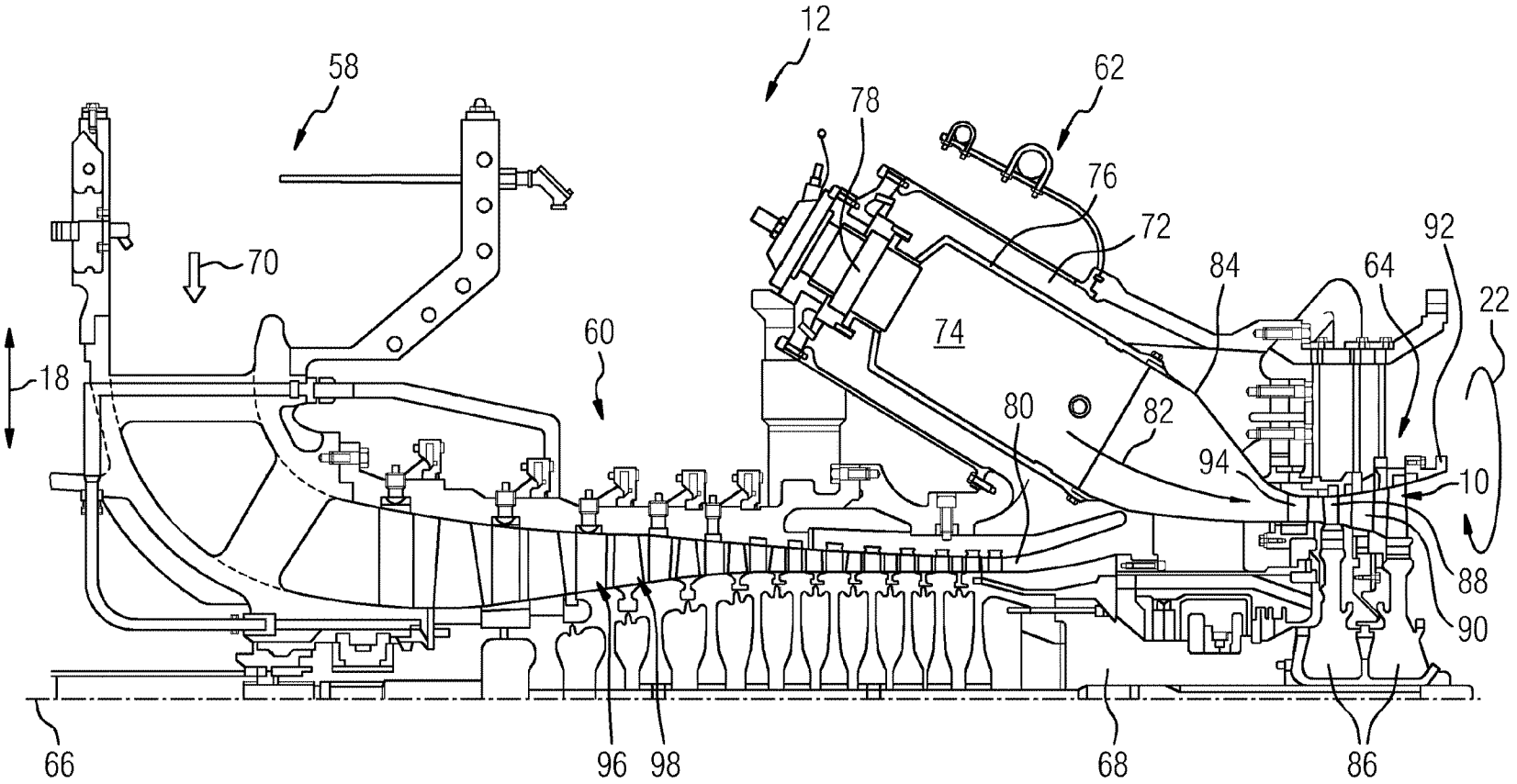
FIG. 1: shows a schematically and sectional view of a gas turbine engine comprising a stator stage assembled according to the inventive method.

FIG. 1 shows an example of a gas turbine engine 12 in a sectional view. The gas turbine engine 12 comprises, in flow series, an inlet 58, a compressor section 60, a combustion section 62 and a turbine section 64, which are generally arranged in flow series and generally in the direction of a longitudinal or rotational axis 66. The gas turbine engine 12 further comprises a shaft 68 which is rotatable about the rotational axis 66 and which extends longitudinally through the gas turbine engine 12. The shaft 68 drivingly connects the turbine section 64 to the compressor section 60.

In operation of the gas turbine engine 12, air 70, which is taken in through the air inlet 58 is compressed by the compressor section 60 and delivered to the combustion section or burner section 62. The burner section 62 comprises a burner plenum 72, one or more combustion chambers 74 defined by a double wall can 76 and at least one burner 78 fixed to each combustion chamber 74. The combustion chamber(s) 74 and the burner(s) 78 are located inside the burner plenum 72. The compressed air passing through the compressor section 60 enters a diffuser 80 and is discharged from the diffuser 80 into the burner plenum 72 from where a portion of the air enters the burner 78 and is mixed with a gaseous or liquid fuel. The air/fuel mixture is then burned and the combustion gas 82 or working gas from the combustion is channelled via a transition duct 84 to the turbine section 64.

The turbine section 64 comprises a number of blade carrying production discs 86 or turbine wheels attached to the shaft 68. In the present example, the turbine section 64 comprises two discs 86 each carry an annular array of turbine blades 88. However, the number of blade carrying production discs 86 could be different, i.e. only one production disc 86 or more than two production discs 86. In addition, stator stages 10 or turbine cascades are disposed between the turbine blades 88. Each stator stage 10 carries an annular array of guiding vanes 90, which are fixed to a stator 92 of the gas turbine engine 12. Between the exit of the combustion chamber 74 and the leading turbine blades 88 inlet guiding vanes or nozzle guide vanes 94 are provided.

The combustion gas 82 from the combustion chamber 74 enters the turbine section 64 and drives the turbine blades 88 which in turn rotate the shaft 68. The guiding vanes 90, 94 serve to optimise the angle of the combustion or working gas 82 on to the turbine blades 88. The compressor section 60 comprises an axial series of guide vane stages 96 and rotor blade stages 98 with turbine blades 88 or vanes 90, respectively.

Figure 2:
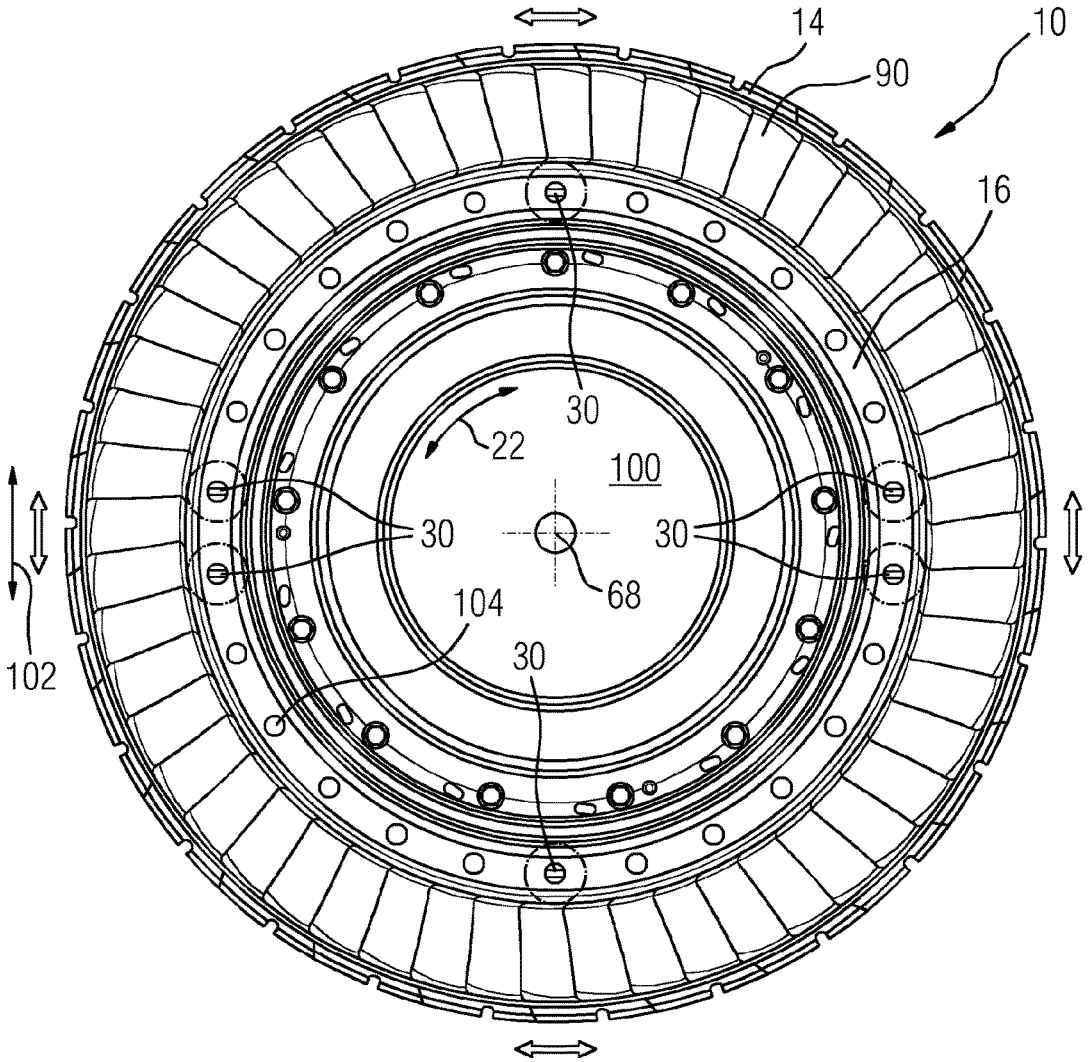
FIG. 2: shows a front view of the stator stage from FIG. 1, FIG. 3: shows a vane segment, a central section and an adjustment pin from the stator stage from FIG. 1 during assembly.

In FIG. 2 a front view of the stator stage 10 is shown. The stator stage 10 comprises a central section 16 with a centre hole 100 through which the turbine shaft 70 is guided. Moreover, the stator stage 10 comprise several vane segments 14 that built an annular shape and runs along a circumferential direction 22 all around the central section 16. Furthermore, the vane segment 14 may comprise one, two or a plurality of aerofoils or vanes 90 and several vane segments 14 form together an annular vane segment 14. Generally, the stator stage 10 may be formed of an upper half and a lower half or as a single 360° piece (not shown). In case of the embodiment with two halves, each half comprises three adjustment pins 30 to connect the vane segments 14 to the central section 16. By applying at least three adjustment pins 30 to each half of the stator segment 16, each half is adjustable along the required degrees of freedom (as indicated by the arrows). For example each half of the stator stage 10 may be adjusted along e.g. a radial direction 102 and the circumferential direction 22, i.e. along the vertical and a horizontal direction as indicated by the arrows.

After adjusting (details see below) the relative position of the central section 16 with respect to the vane segments 14, a plurality of concentric pins 104 may be attached in order to fix and support the central section 16 to the vane segments 14.

Figure 3:
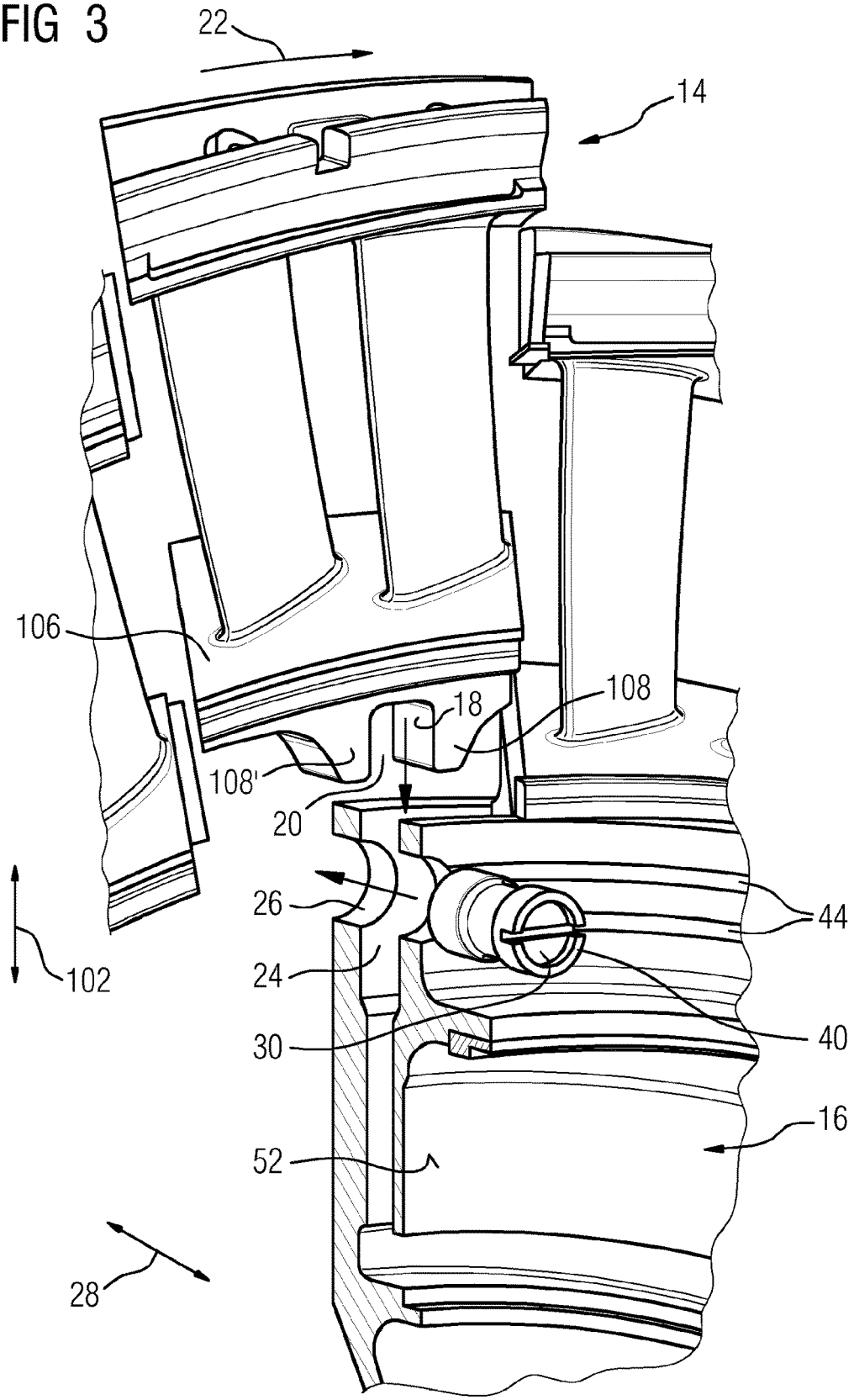

With reference to FIG. 3 an assembling method for assembling the stator stage 10 of the gas turbine engine 12 will be described in the following text.

The vane segment 14 comprises at an inner platform 106 two radial extensions 108, 108' and a gap 20 separating the extensions 108, 108' in circumferential direction 22. To interact with the extension 108, 108' the central section 16 comprises a circumferential slot 24 with a radial depth matched to the radial length of the extensions 108, 108'. Moreover, the central section 16 comprises an axial through hole 26 passing in a direction 28 basically perpendicular to the circumferential direction 22 as well as in radial direction 102 of the slot 24 and specifically in axial direction 28 through the slot 24.

To assemble the stator stage 10 the adjustment pin 30 is inserted into the through hole 26 (see arrow) such that the extensions 108, 108' straddles the middle portion 36 of the adjustment pin 30. Subsequently, the radial extension 108, 108' of the vane segment 14 are inserted into the slot 24 of the central section 16 (see arrow) so that the gap 20 between the extensions 108, 108' is circumferentially aligned with the through hole 26 of central section 16. Since the radial extensions 108, 108' are narrower than the end sections 32, 34 of the adjustment pin 30 the adjustment pin 30 is axially held in position by the vane segment 14. This is so, because the radial extension 108 and 108' are trapped between the end section 32, 34 i.e. the adjustment pin 30 cannot move axially beyond the play of the assembly.

Once all vane segments 14 and adjustment pins 30 are in the central section 16 the whole assembly is lifted into a carrier ring/inner casing of the gas turbine engine 12 and the vane segment 14 is positioned by location pins in the inner casing (not shown in detail).

To position the central section 16 correctly in the stator stage 10 and in respect to the inner casing the adjustment pin 30 is now rotated in circumferential direction 22. This is done through an interaction of a wall segment 18 or a surface of the extension 108 with an action device 38 of the adjustment pin 30 (details see below).

Figure 4:
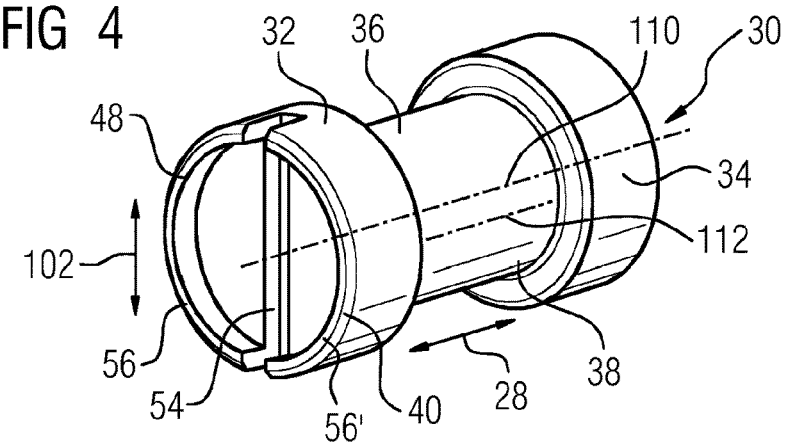
FIG. 4: shows in a perspective view the adjustment pin with a deformable part from FIG. 3.
Figure 5:
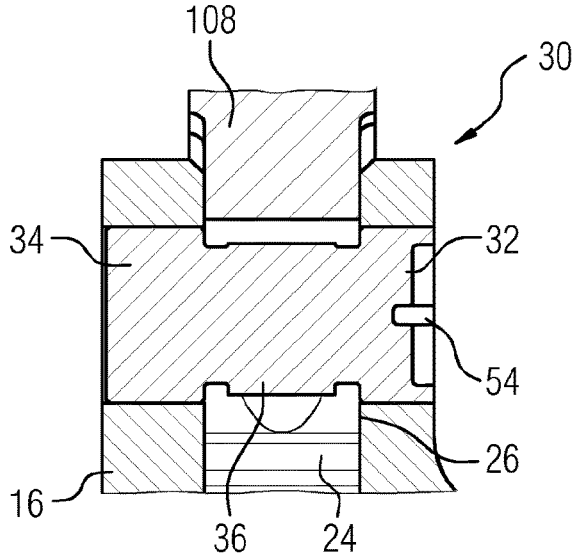
FIG. 5 shows a sectional view through the adjustment pin assembled in the through hole of the stator stage from FIG. 3, FIG. 6: shows schematically and in a front view the adjustment pin from FIG. 4 after a deformation and a locking in corresponding grooves.

The adjustment pin 30 is shown in FIGS. 4 and 5 in more detail, which show a perspective view of the adjustment pin 30 as well as a cross section through the adjustment pin 12 assembled in the through hole 26 of the stator stage 10. The adjustment pin 26 comprises two end sections 32, 34, namely a first end section 32 and a second end section 34, and a middle portion 36 extending between the end sections 32, 34. The middle portion 36 has an action device 38 to mediate a rotation of the adjustment pin 30 to the vane section 14 (see below). The action device 38 is embodied as an eccentrically arranged middle portion 36.

The first end section 32 and the second end section 34 comprise a common centre axis 110 (symmetry axis). The eccentric middle portion 36 in turn comprises a further centre axis 112 (symmetry axis) which is parallel to the centre axis 110 of the first and second end sections 32, 34, wherein the further centre axis 112 is spaced by a predefined distance from the centre axis 110. Hence, because the central section 16 is due to a tight fit between the end sections 32 34 and the through hole 26 coupled to the end sections 32, 34 and the vane segment 14 is coupled via the contact of the wall segment 18 with the eccentric middle portion 36 to the eccentric middle portion 36, a pivoting of the adjustment pin 30 adjusts the relative position between the central section 16 and the vane segment 14.

Moreover, as shown in FIG. 4, the adjustment pin 30 is formed in a dumbbell shape, i.e. the diameters of the first end section 32 and the second end section 34 are larger than the diameter of the eccentric middle portion 36. The adjustment pin 30 further comprises in its end section 32 a drive slot 54 extending basically perpendicular to the axial direction 28 of the adjustment pin 30. The rotation of the adjustment pin 30 is actuated by a tool, like a screw driver, inserted in the drive slot 54.

Once the require concentricity has been achieved the adjustment pin 30 must be locked into place to avoid movement of the central section 16. Therefore the adjustment pin 30 comprises a deformable part 40 embodied as a protrusion 40 or a castellated ridge 40 of the first end section 32. The protrusion 40 extends with about 2 mm in axial direction 28 of the adjustment pin 30 and at least partially along a circumference 52 of the first end section 32. The deformable part 40 is divided by the drive slot 54 in two sectors 56, 56'.

For the correct positioning of the vane segment 14 and the central section 16 the deformable part 40 of the adjustment pin 30 is deformed so that the now deformed part 40 establishes a force fit with a segment 42 of a corresponding structure 44 of the central section 10 and thereby locking the adjustment pin 30 and thus the central section 16 in a fixed or their respective circumferential position in the stator stage 10.

Figure 6:
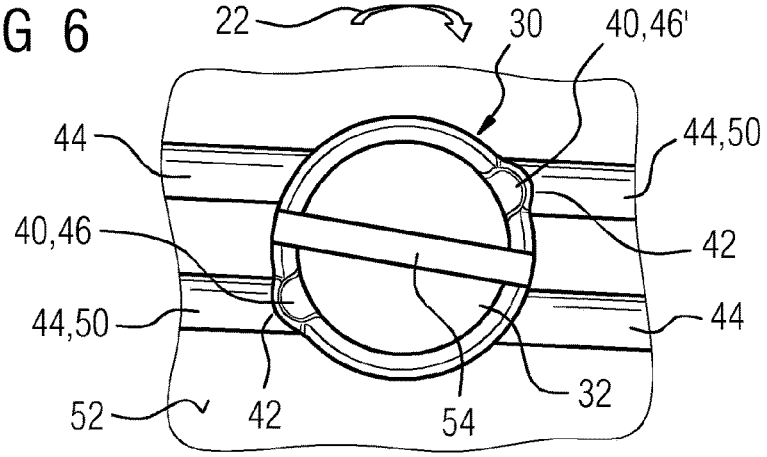

The deformation of the deformable part 40 of the adjustment pin 30 is done by peening. This can be easily performed because the deformable part 40 is arranged in such a way in the through hole 26 to be accessible from an outside of the stator stage 10 (see FIG. 5). The deformed part 40 could be seen in FIG. 6 that shows a front view the adjustment pin 30 after deformation and the locking in the corresponding structure 44. As could be seen in FIG. 6 only sections 46, 46', especially two diametrically opposed arranged sections 46, 46', of the deformable part 40 are deformed or are being built during the deformation instead of the whole ridge 40. Moreover, only sections 46, 46' being located axially over the corresponding structure 44 can be deformed and locked. In general, it would be additionally also possible to deform only one section 46, 46 or to deform all four sections overlapping with the corresponding structure 44.

The corresponding structure 44 of the central section 16 is for each section 46, 46' embodied as a groove 50 extending in an outer surface 52 of the central section 16 and in circumferential direction 22 of the central section 16. Thus, each deformed section 46, 46' is locked in one of the two circumferential grooves 50.

In short a use of an adjustment pin 30 in an assembling method to lock the central section 16 in the stator stage 10 is described. And specifically, a use of a conjunction of an eccentric adjustment pin 30 with a castellated circumferential ridge 40 for deformation especially by peening.

In FIGS. 7 to 11 alternative embodiments of the adjustment pin 30 and the corresponding structure 44 are shown. Components, features and functions that remain identical are in principle substantially denoted by the same reference characters. To distinguish between the embodiments, however, the letter "a" to "d" has been added to the different reference characters of the embodiment in FIGS. 1 to 6. The following description is confined substantially to the differences from the embodiment in FIGS. 1 to 6, wherein with regard to components, features and functions that remain identical reference may be made to the description of the embodiment in FIGS. 1 to 6.

Figure 7:
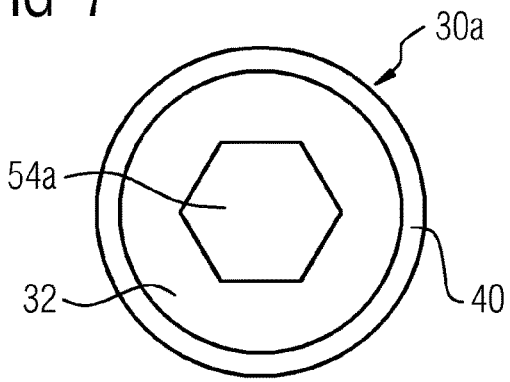
FIG. 7: shows schematically a first alternatively embodied drive slot of an adjustment pin.

FIG. 7 shows schematically a first alternatively embodied drive slot 54*a* of an adjustment pin 30*a*. The embodiment from FIG. 7 differs in regard to the embodiment according to FIGS. 1 to 6 in that the drive slot 54*a* is embodied as a hex head slot.

Figure 8:
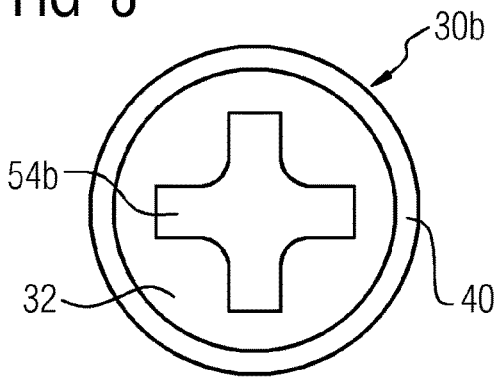
FIG. 8: shows schematically a second alternatively embodied drive slot of an adjustment pin.

In FIG. 8 a second alternatively embodied drive slot 54*b* of an adjustment pin 30*b* is schematically shown. The embodiment from FIG. 8 differs in regard to the embodiment according to FIGS. 1 to 6 in that the drive slot 54*b* is embodied as a cross head slot.

Figure 9:
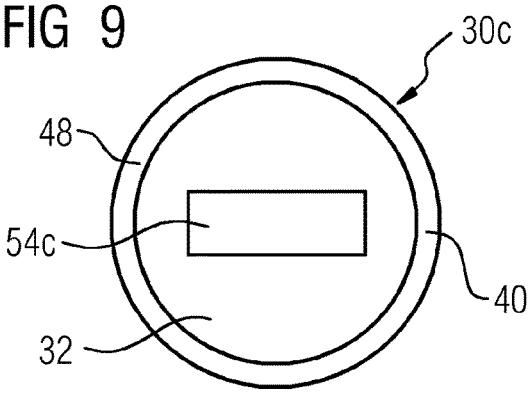
FIG. 9: shows schematically a third alternatively embodied drive slot of an adjustment pin.
Figure 10:
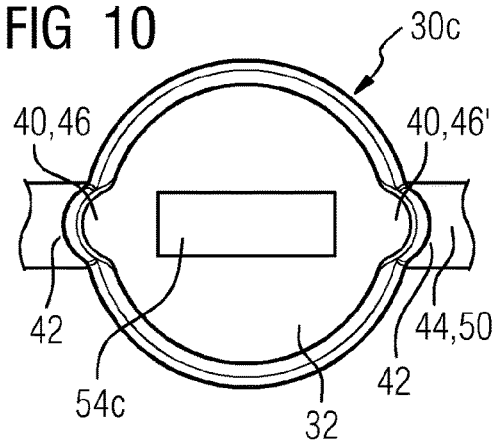
FIG. 10: shows schematically the deformed part of the adjustment pin from FIG. 9 after a deformation and a locking in a corresponding groove

FIGS. 9 and 10 show schematically a third alternatively embodied drive slot 54*c* of an adjustment pin 30*c*. The embodiment from FIGS. 9 and 10 differs in regard to the embodiment according to FIGS. 1 to 6 in that the drive slot 54*c* is embodied as a shortened rectangular slot 54*c*. Thus, the deformable part 40 extends along the whole circumference 48 of the first end section 32. With such an embodied drive slot 54*c* the adjustment pin 30*c* can be locked with two deformable sections 46, 46' in two segments 42 of just one corresponding structure 44 or groove 50.

Figure 11:
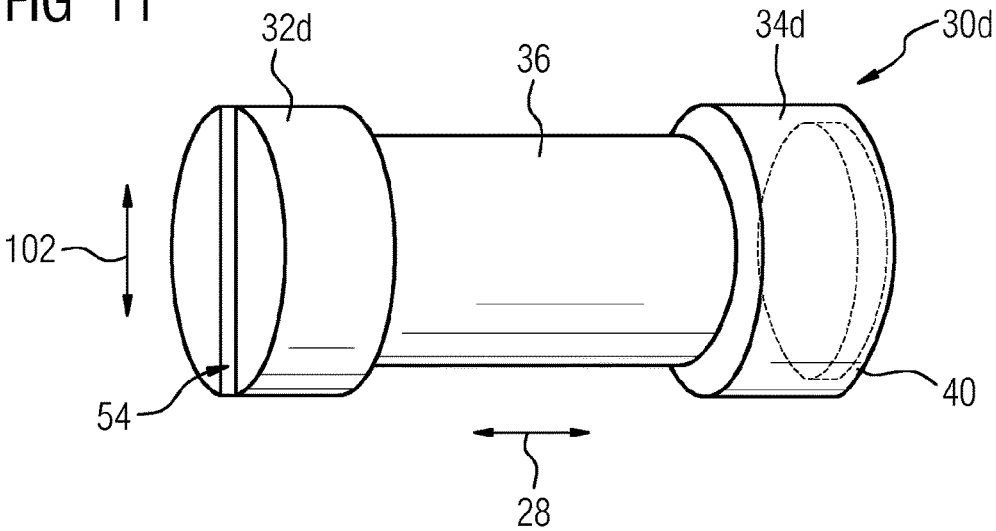
FIG. 11: shows schematically an alternatively embodied adjustment pin.

In FIG. 11 an alternatively embodied adjustment pin 30*d* is schematically shown. The adjustment pin 30*d* comprises a first end section 32*d* and a second end section 34*d*. In the first end section 32*d* a drive slot 54*d* is arranged and at the second end section 34*d* the deformable part 40 is arranged.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

The invention claimed is:

1. A method for assembling a stator stage of a gas turbine engine, comprising at least one vane segment and at least a central section, wherein the vane segment comprises at least one wall segment and a gap, wherein the at least one wall segment restricts the gap in at least one direction, wherein the central section comprises at least one circumferential slot and an axial through hole passing in a direction basically perpendicular to a circumferential direction of the slot through the slot, the method comprising:

inserting an adjustment pin into the through hole, wherein the adjustment pin comprises two end sections and a middle portion extending between the end sections and having at least one action device, inserting the at least one wall segment of the vane segment in the slot of the central section so that the gap is circumferentially aligned with the through hole of the central section, rotating the adjustment pin in its circumferential direction so that the central section is correctly positioned in the stator stage through interaction of the at least one wall segment with the at least one action device of the adjustment pin, deforming a deformable part of the adjustment pin so that the now deformed part establishes a force fit with at least one segment of a corresponding structure of the central section, and thereby locking the adjustment pin and thus the central section in a fixed position in the stator stage.

2. The method according to claim 1, wherein at least one section of the deformable part of the adjustment pin is deformed.

3. The method according to claim 1, wherein the deformable part is embodied as a protrusion of at least one end section of the adjustment pin and extends in an axial direction of the adjustment pin and at least partially along a circumference of the at least one end section.

4. The method according to claim 1, wherein the corresponding structure of the central section is a groove, wherein the deformed part of the adjustment pin is locked in the groove of the central section, and/or wherein the corresponding structure is a groove extending in an outer surface of the central section and in circumferential direction of the central section.

5. The method according to claim 1, wherein at least two deformed sections of the deformed part are built during the deformation and wherein the central section comprises at least two circumferential grooves in an outer surface of the central section and wherein each deformed section is locked in one of the two circumferential grooves.

6. The method according to claim 1, wherein the deformable part of the adjustment pin is arranged in such a way in the through hole to be accessible from an outside of the stator stage.

7. The method according to claim 1, wherein the action device of the adjustment pin is embodied as an eccentrically arranged middle portion and wherein the eccentric middle portion contacts the at least one wall segment of the vane segment to correctly position the central section in the stator stage.

8. The method according to claim 1, wherein the adjustment pin and/or the central section is locked in its circumferential position in the stator stage.

9. The method according to claim 1, wherein the deformable part of the adjustment pin is deformed by peening.

10. A stator stage of a gas turbine engine, comprising at least one vane segment and at least a central section, wherein the vane segment comprises at least one wall segment and a gap, wherein the at least one wall segment restricts the gap in at least one direction, wherein the central section comprises at least one circumferential slot and an axial through hole passing in a direction basically perpendicular to a circumferential direction of the slot through the slot, an adjustment pin, wherein the adjustment pin is inserted into the through hole, wherein the adjustment pin comprises two end sections and a middle portion extending between the end sections and having at least one action device, wherein the at least one wall segment of the vane segment is inserted in the slot of the central section so that the gap is circumferentially aligned with the through hole of the central section, wherein the adjustment pin is arranged in its circumferential direction so that the central section is correctly positioned in the stator stage through interaction of the at least one wall segment with the at least one action device of the adjustment pin, wherein a deformable part of the adjustment pin is deformed so that the now deformed part establishes a force fit with at least one segment of a corresponding structure of the central section and thereby wherein the adjustment pin and thus the central section are locked in a fixed position in the stator stage.

11. The stator stage according to claim 10, wherein the deformable part is embodied as a protrusion of at least one end section and extends in an axial direction of the adjustment pin and at least partially along a circumference of the at least one end section.

12. The stator stage according to claim 10, further comprising:

a drive slot extending basically perpendicular to the axial direction of the adjustment pin and/or wherein the drive slot divides the deformable part in two sectors.

13. The stator stage according to claim 12, wherein the drive slot is embodied as a hex head slot or wherein the drive slot is embodied as a cross head slot.

14. The stator stage according to claim 12, further comprising:

a first and a second end section, wherein the drive slot is arranged in the first end section and the deformable part is arranged at the second end section.

* * * * *